United States Patent [19]

Gurries et al.

[11] 4,454,666

[45] * Jun. 19, 1984

[54] RESONANCE AIDED FRONT END LOADER

[75] Inventors: Raymond A. Gurries, Reno; Harry J. Stormon, Sparks, both of Nev.

[73] Assignee: Resonant Technology Company, Sparks, Nev.

[ * ] Notice: The portion of the term of this patent subsequent to Nov. 16, 1999 has been disclaimed.

[21] Appl. No.: 363,216

[22] Filed: Mar. 29, 1982

Related U.S. Application Data

[63] Continuation of Ser. No. 135,797, Mar. 31, 1980, abandoned.

[51] Int. Cl.[3] ..... E02F 3/81

[52] U.S. Cl. ..... 37/118 R; 37/141 R; 37/DIG. 18; 172/40

[58] Field of Search ..... 172/40; 37/DIG. 18, 37/141 R, 141 T, 142 R; 299/14

[56] References Cited

U.S. PATENT DOCUMENTS

| | | | |
|---|---|---|---|
| 3,113,390 | 12/1963 | Pewthers | 37/142 R |
| 3,145,488 | 8/1964 | French | 37/DIG. 18 |
| 3,238,646 | 3/1966 | Oldenburg | 37/141 R |
| 3,328,904 | 7/1967 | Voigt et al. | 37/DIG. 18 |
| 3,367,716 | 2/1968 | Bodine | 172/40 X |
| 3,478,450 | 11/1969 | Cunningham | 37/141 R |
| 3,563,316 | 2/1971 | Shatto | 172/40 |
| 3,633,683 | 1/1972 | Shatto, Jr. | 172/40 X |
| 3,645,021 | 2/1972 | Sonerud | 37/142 R X |
| 4,229,045 | 10/1980 | Gurries | 37/DIG. 18 |
| 4,258,956 | 3/1981 | Gurries | 37/DIG. 18 |
| 4,359,102 | 11/1982 | Gurries et al. | 172/40 |

OTHER PUBLICATIONS

"Automotive Engineering", Nov. 1978, pp. 74–80.

Brown, Joseph M., "Soil Excavation Improvement from Bulldozer Blade Oscillation", Technical Paper of Society of Automotive Engineers, Inc., Sep. 1978.

*Primary Examiner*—Clifford D. Crowder

*Attorney, Agent, or Firm*—Townsend and Townsend

[57] ABSTRACT

A front end loader has a loading bucket secured to a tractor and a transversely elongate cutter blade closely spaced forward of a lower front edge of the bucket. Improved apparatus for reciprocating the blade in forward and aft directions relative to the front edge of the bucket is disclosed. A force transmitting beam has a resonant frequency with at least on node and first and second anti-nodes at the resonant frequency. A source of vibrations at or near the resonant frequency is coupled to the beam near the first anti-node to vibrate the second anti-node about a neutral position. The beam is secured near one node so as to locate the neutral position of the second anti-node in spaced relationship from the cutting blade within striking distance thereof. The second anti-node thus applies unidirectional force impulses to the blade in a forward direction as the second anti-node vibrates to drive the blade intermittently forward.

29 Claims, 3 Drawing Figures

RESONANCE AIDED FRONT END LOADER

This is a continuation of application Ser. No. 135,797, filed Mar. 31, 1980, now abandoned.

BACKGROUND OF THE INVENTION

This invention relates to earth-working equipment, and, more particularly, to more efficient use of vibration energy as an aid to the operation of front end loaders and the like.

Front end loaders are in common use on construction sites and elsewhere. A front end loader generally comprises a large loading bucket for earth digging and loading. The bucket is carried on the front end of a tractor. A tractive force of the tractor pushes the bucket forward to scoop up a load of loose material, and the bucket then can be lifted for carrying and unloading the material. An elongate blade typically extends across the lower front edge of the bucket for assisting penetration of the bucket into the material being scooped up.

There is a need to reduce the tractive force required for a front end loader to penetrate the material being loaded. For example, if the material being loaded suddenly cannot be penetrated, the vehicle can spin its tires when applying a tractive force. Premature tire wear can be a considerable expense for front end loaders but this expense can be avoided by reducing the required tractive force in penetrating the material. In the past, efforts have been devoted to the use of high-frequency vibrating blades on the bucket of a front end loader as an aid to reducing the required tractive force. U.S. Pat. No. 3,238,646 to Oldenburg discloses one prior effort in which the blade is connected to a vibrating eccentric through a bell crank for imparting vibration to the blade in forward and aft directions. U.S. Pat. No. 3,328,904 to Voigt et al discloses a power assisted loading bucket having reciprocally mounted teeth at the front edge of the bucket.

SUMMARY OF THE INVENTION

Apparatus for resonantly driving a movable cutter blade located at the base of a concave tool such as a loading bucket is disclosed. An angulate beam is provided which has first and second legs meeting at a juncture at an included angle which conforms to the shape of the concave tool. The beam includes a mounting flange integrally formed as a part of the beam and extending from the juncture inwardly between the legs and at a fixed angle relative to the legs. The beam has a resonant frequency, when restrained at the mounting flange, with a node at the juncture and first and second antinodes at the respective ends. An oscillator vibrates the free end of the first leg of the beam at or near its resonant frequency so that the free end of the second leg vibrates about a neutral position. The mounting flange is attached directly to the concave tool. The angulate beam moves with the tool with the neutral position at the end of the second leg spaced from the back of the cutter blade. The free end of the second leg is within striking distance of the back of the cutter blade so that vibration of the second leg imparts forward impulses to the cutter blade to drive the blade intermittently forward.

In the prior art devices referred to above, the actuator not only imparts a forward force on the cutter blade, but an equal and opposite rearward force on the supporting structure. The present invention, by utilizing a resonant beam secured to the bucket at the node, avoids the imposition of equal and opposite forces on the support. Because of the absence of the equal and opposite reaction forces on the support structure, much larger forces can be imparted on the cutting blade with the apparatus of the present invention so that the cutter blade can cut through hard materials. In many instances, this can reduce number of operations required, for example by eliminating the need for an additional piece of equipment to initially rip or loosen the material being loaded.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
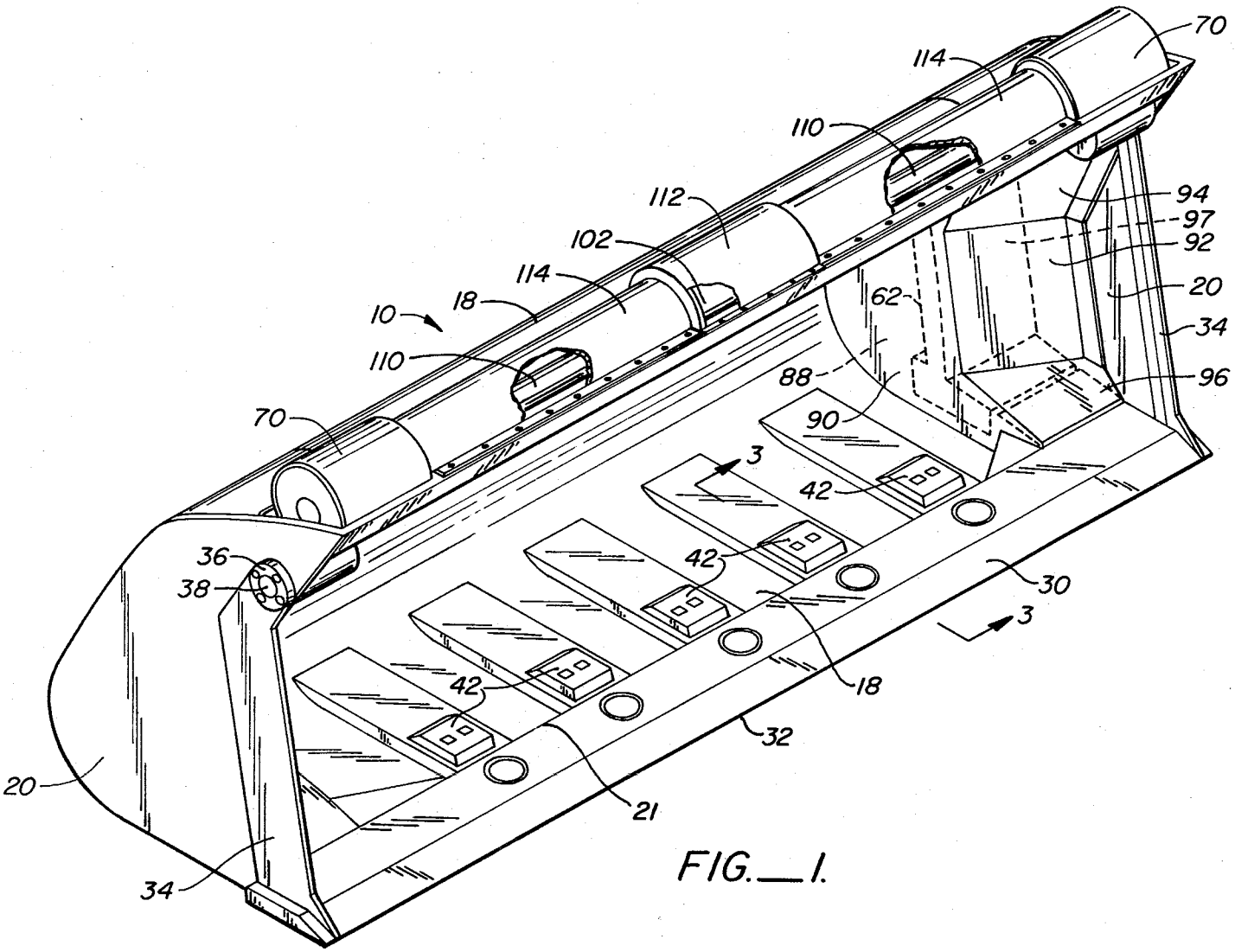
FIG. 1 is a perspective view showing a bucket loader according to principles of this invention.

Referring to the drawings, a front end loader bucket 10 is conventionally secured to upright rear support members 12 (see FIG. 2) on opposite sides of the bucket center line. Bucket 10 is secured to the front end of a tractor, not shown, by a pair of parallel push and lift arms 14 secured to lower portions of the rear support members 12 and a pair of roll back and dump cylinders 16 secured to upper portions of the rear support members.

Figure 2:
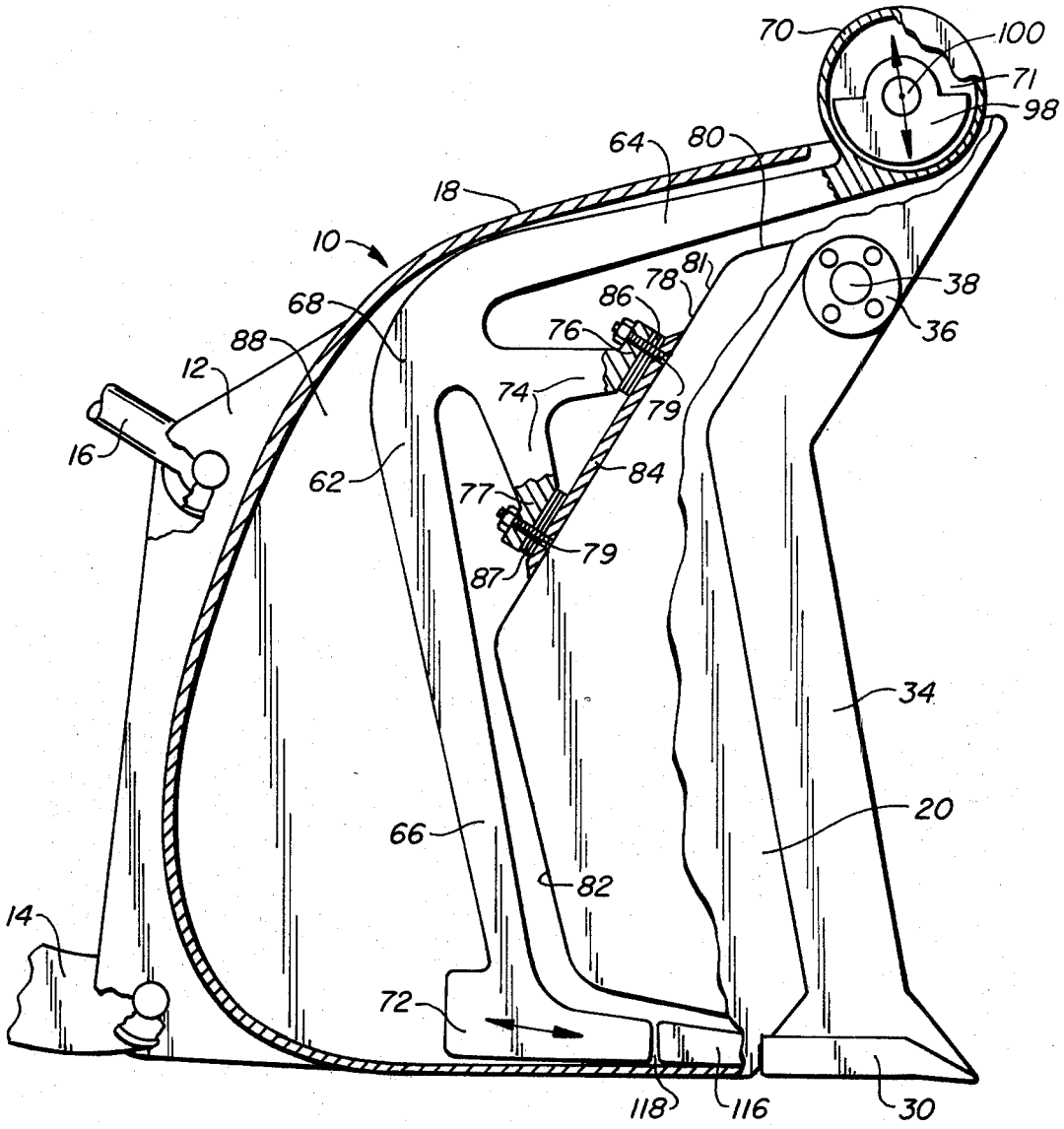
FIG. 2 is a side elevation view of the embodiment of FIG. 1 with portions broken away.

The bucket generally includes a concave metal shell 18 which is elongate and generally C-shaped when viewed from an end as in FIG. 2. Metal end plates 20 are rigidly secured to opposite ends of shell 18. The bucket thus produces a generally elongate laterally extending hollow interior area with a concave rear wall formed by the shell 18 of the bucket, with a laterally extending front opening between the end plates 20. The bucket also has an elongate lower edge 21 extending across the front of the bucket between the end plates.

A transversely elongate cutter blade 30 extends across and in front of the lower front edge 21 of the bucket. Cutter blade 30 has a blade edge 32 that penetrates loosened material being loaded into the bucket. The opposite ends of the cutter blade are attached, for example by welding, to the bottoms of a pair of upright hanger arms 34. The top of each hanger arm has a pivot 36 and a corresponding pivot pin 38 affixed to the pivot. The hangers are outboard the end plates, and the pivot pins are journaled for rotation in corresponding bearings inside the end plates. The hangers pivot relative to the end plates about a tranverse axis through the pivot pins to permit the cutter blade to reciprocate relative to the bucket.

Figure 3:
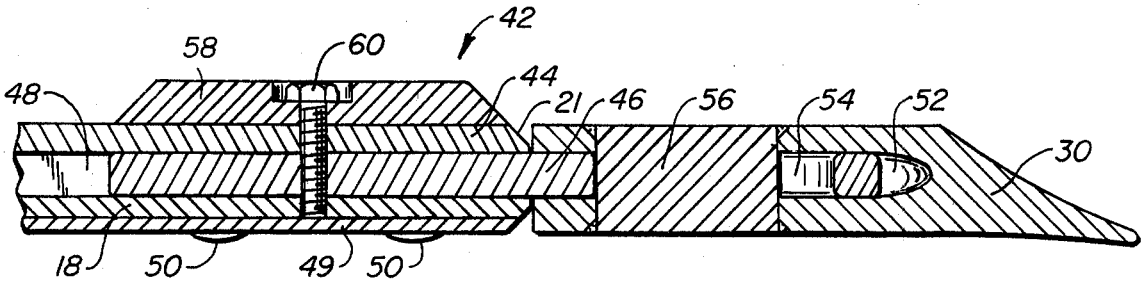
FIG. 3 is a fragmentary sectional view taken on line 3—3 of FIG. 1.

The length of blade 30 is supported adjacent lower front edge 21 of bucket 18 by a plurality of laterally spaced apart blade supports 42. Blade supports 42 are identical and are understood best by referring to FIG. 3. Each blade support 42 includes an elongate rigid stiffening member 44 rigidly affixed to the floor of bucket shell 18. Each stiffening member is immediately inboard the front edge 21 of the bucket and extends perpendicularly away from the front edge of the bucket in an aft direction. Separate attachment plates 46 have rear portions fastened to stiffening members 44 and front portions fastened to laterally spaced apart locations along the body of cutter blade 30. Rear portions of the attachment plates extend into corresponding channels 48 formed in the stiffening members. Separate plates 49 cover the bottom surface of the shell below the attachment plates 46. The rear portions of attachment plates 46, together with the bottom plates 49 and stiffening member 44, are rigidly affixed to the shell by fasteners such as bolts 50. Protective covers 58 cover the attachment bolts 50, 60 and each protective cover is fastened to the stiffening members and the attachment plates by bolts 60.

The front portions of attachment plates 46 are secured to the body of blade 30 in a slidable arrangement which permits the blade to move forward and aft relative to the lower front edge 21 of the shell. The front portions of attachment members 46 extend into corresponding elongate slots 52 penetrating the rear of the blade. The slots are elongated in the direction of movement of blade 30. Separate oblong holes 54 extend through the front portions of attachment plates 64. The length of each oblong hole 54 is aligned with the direction of movement of blade 30. Separate fixed pins 56 extend through oblong holes 54 for slidably attaching blade 30 to attachment plates 46. Each pin 56 is rigidly affixed, for example by welding, to the body of blade 30 above and below slot 52. Pins 56 are circular in cross-section and smaller in diameter than long dimension of slots 54. This means of attachment enables cutter blade 30 to reciprocate fore and aft as the pins ride in the elongated slots 54, thereby guiding the cutter blade and taking up side and vertical thrust; and rear edge portions of the oblong holes engage the rear portions of the pins to act as stops thereby limiting the stroke of the cutter blade in its aft direction. Specifically, the maximum stroke of cutter blade 30 is equal to the long dimension of oblong holes 54.

Referring to FIGS. 1 and 2, separate angulated force transmitting resonant beams 62 are disposed adjacent the inside faces of each end wall 20 of bucket 18. Beams 62 are matched in the sense that they resonate at the same frequency, have the same dimensions, and are made from the same material. Each beam 62 is preferably of one piece cast or machined construction, and includes diverging, approximately straight upper and lower legs 64 and 66 that meet at a junction 68 to form an acute, approximately 90 degree, angle. Each beam 62 also includes an oscillator housing 70 at the end of the upper leg, a hammer 72 at the end of the lower leg, a pair of intermediate extensions 74 at the juncture of the beam extending outwardly at an angle that bisects the upper and lower legs, and transverse mounting flanges 76 and 77 formed on the ends of the intermediate extensions.

The resonant beams are rigidly affixed to separate angulated beam mounting webs 78 which, in turn, are rigidly affixed to the inside walls of the end plates 20, for example by welding. Each web 78 is generally C-shaped and includes a straight upper leg 80 extending generally parallel to and below the upper leg of the resonant beam, an upper intermediate leg 81 extending downwardly and in an aft direction at a relatively steep angle generally parallel to mounting flanges 76, 77 of resonant beam 62, a lower intermediate leg 82 extending generally downwardly at a relatively steep angle and generally parallel to lower leg 66 of the resonant beam, and a lower leg 83 which extends downwardly and in a forward direction at a relatively shallow angle generally parallel to hammer portion 72 of the resonant beam.

Separate mounting pads 84 are formed on the rear surface of the upper intermediate leg of each web. The resonant beams are mounted to the back of each upper intermediate leg by bolts 79 extending through the mounting flanges 76 and 77 of the resonant beams and the mounting pads 84 of the webs. Shims 86 and 87 are interposed between the mounting flanges and the pads to precisely set, at the time of assembly and readjust in the course of operation, the position of each hammer 72 with respect to blade 30.

Separate protective cavities 88 are formed inboard of the end walls of the bucket for housing the resonant beams and the beam mounting webs. Each protective cavity is formed, in part, by a vertical side wall 90 spaced from and extending parallel to the end plates of the bucket. Each side wall supports the outer edge of the beam mounting web 78 and is rigidly affixed, say by welding, to the rear inside surface of the bucket shell for support. Each side wall 90 extends from the bottom to the top inside surface of the bucket and extends alongside each resonant beam. Each cavity also includes an angular deflector wall 92 extending at an angle from the side wall 90 toward the inside face of the end plate 20, an upper plate 94 extending from the top of the deflector 92 toward the inside face of the end plate, and a lower plate 96 extending from the base of the deflector 92 in a forward direction and at a relatively shallow angle for covering the hammer portion of the resonant beam and the portion of the cutter blade contacted by the hammer. An upright front wall 97 is rigidly affixed between the inside of the end plate and the upper and lower plates 94, 96 and the deflector 92. The wall structure surrounding each cavity 88 forms a deflector for material entering the bucket and also forms a guard for resonant beam 62 inside each cavity.

Referring again to resonant beams 62, when restrained at each juncture 68, the beams have a node at the juncture and anti-nodes at the ends of the upper and lower legs 64 and 66, when excited at or near an appropriate resonant frequency. The anti-node at the end of upper leg 64 serves as an input of beam 62 and the anti-node at the end of lower leg 66 serves as the output of the beam. The upper and lower legs 64, 66 are each tapered in thickness from the juncture 68 of beam 62 to their respective ends, i.e., as depicted in FIG. 2 each leg is wider near the juncture than it is near its end, for the purpose of equalizing the bending stresses along the length of each leg.

An oscillator 71 is disposed in housing 70. Oscillator 71 comprises at least one, and preferably three eccentric weights 98 mounted on a shaft 100, which is journaled for rotation in the housing 70. Preferably, the weight of hammer 72 is equal to or less than the weight of the oscillator, including its housing, shaft, bearings and eccentric weights. If the hammer is too heavy, the input anti-node vibrates with a larger amplitude than the output anti-node.

A double-ended hydraulic motor 102 (see FIG. 1) is mounted to the upper rear portion of bucket shell 18. Motor 102 is preferably a hydraulic motor driven by a hydraulic pump located on the tractor and not shown. Flexible drive shafts 110 couple the opposite output shafts of the motor to oscillators 71 in the housings 70 at opposite ends of the bucket. A motor guard 112 and drive shaft covers 114 provide protection for the motor and drive shafts, respectively.

As the eccentric weights rotate on the shaft at or near the resonant frequency of the beam, the beam is excited into at least near resonant vibration. The input anti-node at the end of upper leg 64 of the beam vibrates transversely to its length, the output anti-node of the lower leg 66 vibrates transversely to its length, and the hammer 72 intermittently strikes the back of an anvil 116 formed on the back portion of the cutter blade. The anvil portions 116 of the cutter blade 30 are projections formed on opposite ends of the cutter blade which taper in an aft direction toward the front face of each hammer 72.

The neutral position of the output anti-node of each resonant beam 62 is defined herein as its position when the beam is at rest, i.e., when it is not vibrating or being deflected. Regardless of the position of cutter blade 30, it is at all times spaced from the neutral position of the output anti-node of each beam, thereby forming a gap 118. When each beam 62 is energized by its oscillator 71, its output anti-node vibrates, i.e., reciprocates fore and aft; and as the output anti-node moves forward, gap 118 closes and hammer 72 strikes the back of cutter blade 30, and as the hammer moves aft, the gap opens. Specifically, pins 56 serve as tool stops on the aft movement of cutter blade 30 when they contact the rear portions of elongated holes 54 in attachment plates 46. The desired minimum gap is established by the number of shims 86 and 87 which changes the spacing between hammer 72 and anvil surface 116 of the blade.

During operation of oscillator 71 and resonant beams 62, the peak-to-peak vibration excursion amplitude of each output anti-node is generally on the order of one inch. Hammer 72 contacts anvil surface 116 of cutter blade 30 near the forward peak of the vibration excursion of the output anti-node. Hammer 72 drives cutter blade 30 forward relative to the lower front edge of bucket 18, until the pins 56 approach or contact the front portions of the elongated holes 54. As hammer 72 moves aft, out of contact with anvil surface 116 of cutter blade 30, the cutter blade can slide in an aft direction relative to the bucket. This aft motion is produced in response to forward motion applied to bucket 18 by the tractor. As blade 30 moves in a relative aft direction, it can be stopped by the pins 56 engaging the rear portions of the elongated holes 54. During the next cycle hammer 72 moves forward and again strikes cutter blade 30 to drive the cutter blade forward, and this cycle continues to be repeated. In this manner, the hammer applies unidirectional force impulses to the cutter blade to drive the cutter blade intermittently in a forward direction without aft motion as the tractor moves steadily forward relative to the shell of the bucket, the cutter blade reciprocates as the tractor drives the bucket steadily forward and the resonant beam strikes the blade.

The described embodiment of the invention is only considered to be preferred and illustrative of the inventive concepts; the scope of the invention is not to be restricted to such embodiments. Various and other numerous arrangements may be devised by one skilled in the art without departing from the spirit and scope of this invention.

What is claimed is:

1. In a front end loader having a loading bucket which defines a cavity for carrying material, said loading bucket being secured to a tractor, and a transversely elongate cutter blade closely spaced forward of a lower front edge of the bucket, an improved apparatus for reciprocating the blade in the forward and aft directions relative to the front edge of the bucket, the improvement comprising:

a force-transmitting beam having a resonant frequency with at least one node and first and second anti-nodes at the resonant frequency, said beam characterized by two divergent approximately straight legs that meet at a juncture to form an angle less than 180°, and a mounting flange integrally formed in said beam and extending inwardly between said straight legs, said angle chosen to conform to the shape of the loading bucket, the first anti-node being located at the end of one leg, the second anti-node being located at the end of the other leg, and the one node being located at the juncture;

a source of vibrations at or near the resonant frequency coupled to the beam near the first anti-node to vibrate the second anti-node about a neutral position; and means for securing the mounting flange of the beam to the loading bucket so that the beam is supported completely by the loading bucket without additional framework and moves with the loading bucket so as to position the neutral position of the second anti-node in a consistent spaced aft relationship from the cutter blade within striking distance thereof to apply unidirectional force impulses to the blade in a forward direction as the second anti-node vibrates to drive the blade intermittently forward.

2. The improvement according to claim 1 in which the beam attaching means additionally comprises shims disposed between at least one of the flanges and said portion of the bucket to adjust the position of the end of the other leg relative to the cutter blade.

3. The improvement according to claim 1 in which the cutter blade mounting means additionally comprises stop means for preventing aft movement of the cutter blade beyond a point forwardly spaced from the neutral position of the second anti-node.

4. The improvement according to claim 3 in which the stop means comprises a plurality of elongated slots formed in a portion of the bucket in alignment with the direction of movement of the blade, and a plurality of pins riding in the slots and attaching the blade to the bucket to stop the cutter blade when the pins reach the ends of the slots.

5. The improvement according to claim 4 in which the stop means further includes a plurality of laterally spaced apart support members rigidly affixed to the bottom of the bucket and protruding forward of the lower front edge of the bucket; and in which the pins slidably secure the blade to the protruding portions of the members.

6. Apparatus according to claim 5 including laterally spaced apart stiffening members rigidly secured to corresponding support members.

7. The improvement according to claim 4 in which the pins provide guiding means for preventing sideward motion of the cutter blade.

8. The improvement according to claim 1 comprising a pair of said force-transmitting beams matched in their resonant frequency and attached to the bucket adjacent opposite ends thereof.

9. For use on a front end loader, a loading bucket comprising:

an elongate shell shaped as a bucket for receiving material loaded onto the shell;

a transversely elongate cutter blade closely spaced from a lower front edge of the shell;

means for mounting the cutter blade for reciprocal motion in forward and aft directions relative to the lower front edge of the shell;

a force-transmitting beam having a resonant frequency and at least one node and first and second anti-nodes at the resonant frequency, said beam characterized by two divergent legs joined at an angle chosen to allow the beam to be mounted inside the shell and having an integral extension projecting inwardly between the legs;

a source of vibrations at or near the resonant frequency coupled to the beam near the first anti-node to vibrate the second anti-node about a neutral position;

means for securing the integral extension of the beam to the shell so that the beam is supported completely by and is movable with the shell so as to position the neutral position of the second anti-node in a consistent spaced aft relationship from the cutter blade within the striking distance thereof to apply force impulses to the blade in a forward direction as the beam vibrates to drive the blade intermittently forward; and stop means for preventing aft movement of the cutter blade beyond a point forwardly spaced from the neutral position of the second anti-node.

10. Apparatus according to claim 9 in which the stop means comprises a plurality of elongated slots formed in a portion of the bucket in alignment with the direction of movement of the blade, and a plurality of pins riding in the slots and attaching the blade to the bucket to stop the blade when the pins reach the ends of the slots.

11. Apparatus according to claim 10 in which the stop means further includes a plurality of laterally spaced apart support members rigidly affixed to the bottom of the bucket and protruding forward of the lower front edge of the bucket; and in which the pins slidably secure the blade to the protruding portions of the support members.

12. Apparatus according to claim 11 including laterally spaced apart stiffening members rigidly secured to corresponding support members.

13. Apparatus according to claim 10 in which the pins provide guide means for preventing sideward motion of the cutter blade.

14. For use on a front end loader, a loading bucket comprising:

an elongate shell shaped as a bucket and having a generally concave interior surface, end walls at opposite ends of the bucket, and a front edge extending across a lower front portion of the bucket shell;

at least one vertical wall extending between each end wall of the shell and the concave interior surface thereof to form separate protective cavities inside the opposite end walls of the bucket;

a transversely elongate cutter blade closely spaced from the front edge of the shell;

first and second matched force-transmitting beams each having a resonant frequency and at least one node and first and second anti-nodes at the resonant frequency, each of said beams characterized by a pair of divergent legs which meet at an angle selected to conform the beam to the shape of the protective cavity and by an integral extension projecting inwardly from the juncture of the legs;

first and second sources of vibrations at or near the resonant frequency coupled to the respective beams near the first anti-nodes to vibrate the second anti-nodes about respective enutal positions; and means for securing the integral extensions to the vertical walls so that each beam lies inside one of the protective cavities so as to position the neutral positions of the second anti-nodes in a consistent spaced aft relationship from the cutter blade within striking distance thereof at transversely spaced points for applying force impulses to the blade in a forward direction to drive the blade intermittently in the forward direction, the cutter blade having rearward extensions extending into the protective cavities for receiving the force impulses applied by the second anti-nodes.

15. Apparatus according to claim 14 in which each source of vibrations comprises an oscillator housing formed on the end of the leg forming the first anti-node as part of the beam in a one-piece construction, a shaft journaled for rotation in the housing, and at least one eccentric weight mounted on the shaft.

16. Apparatus according to claim 14 in which the side wall of the cavity has at least a portion thereof extending in an upright orientation at an angle facing toward the interior of the bucket for deflecting material into the bucket.

17. For use on a front end loader, a loading bucket comprising:

an elongate shell formed as a bucket and having a generally concave inside surface, a pair of opposite end walls, and a transverse bottom edge extending between the end walls;

a transversely elongate cutter blade extending across and spaced in front of the bottom edge of the bucket;

a pair of elongate blade support arms extending upwardly from the blade proximate opposite end walls of the bucket;

means pivotally securing upper portions of the blade support arms to the bucket for mounting the cutter blade in a closely spaced apart relationship from the bottom edge of the bucket to allow reciprocal motion in fore and aft directions relative to the bottom edge of the bucket;

first and second force-transmitting beams each having two divergent approximately straight legs that meet at a juncture to form an angle, said angle selected to allow the legs to conform to the shape of the shell, a resonant frequency and a node at the juncture, when restrained, a first anti-node at the end of one leg, and a second anti-node at the end of the other leg at the resonant frequency;

a source of vibrations at or near the resonant frequency coupled to each of the first and second beams near the first anti-node;

means including a mounting flange formed integrally with each of said beams and extending inwardly for mounting the first and second beams near their nodes to fixed positions on the shell so that the beams are supported completely by and move with the shell to position the second anti-nodes within striking distance of opposite sides of the cutter blade, the source of vibrations causing the first and second force-transmitting beams to resonate at or near their resonant frequency for applying force impulses to the opposite sides of the cutter blade.

18. Apparatus for resonantly driving a moveable cutter blade located at the base of a concave tool comprising:

an angulate beam having first and second legs meeting at a juncture at an included angle selected to conform to the shape of the concave tool and a mounting flange integrally formed as a part of said beam and extending from the juncture inwardly between the legs and at a fixed angle relative to the legs, said beam having a resonant frequency, when restrained at the mounting flange, with a node at the juncture and first and second antinodes at the respective ends;

means for vibrating the free end of the first leg of the beam at or near the resonant frequency so that the free end of the second leg vibrates about a neutral position; and means for attaching the mounting flange directly to the tool without additional supporting framework so that the angulate beam conforms to the concave shape of the tool and moves with the tool with the neutral position of the free end of the second leg spaced from the back of the cutter blade within striking distance thereof so that vibration of said second leg imparts forward impulses to the cutter blade to drive the blade intermittently forward.

19. The apparatus of claim 18 wherein the free end of the first leg of the angulate beam is located immediately behind the top of the tool so that the shape of the angulate beam corresponds generally to the shape of the back surface of the tool.

20. The apparatus of claim 18 wherein the legs meet at an angle of approximately 90°.

21. The apparatus of claim 18 wherein the vibrating means comprises an eccentric mass oscillator formed as an integral part of the free end of the first leg of the beam.

22. The apparatus of claim 18 wherein the free end of the second leg of the beam includes an enlarged portion providing a weighted hammer for striking the back surface of the cutter blade.

23. Apparatus for resonantly driving a moveable cutter blade located at the base of a concave tool, said apparatus comprising:

an angulate beam having first and second ends meeting at a juncture at an included angle of approximately 90° and a mounting flange integrally formed as a part of said beam and extending from the juncture inwardly between the legs in a fixed position relative to the legs, said beam having a resonant frequency, when restrained at the mounting flange, with a node at the juncture and first and second antinodes at the respective ends, said beam including an integral housing at the free end of one leg of the beam and an enlarged portion providing a weighted hammer at the free end of the second leg of the beam;

an eccentric oscillator located within the housing to apply vibrational forces to the beam at or near the resonant frequency so that the second end vibrates about a neutral position; and means for attaching the mounting flange directly to the tool without additional supporting framework so that the angulate beam conforms to the concave shape of the tool and moves with the tool with a first end proximate the top edge of the tool and the neutral position of the second end spaced from the back of the cutter blade within striking distance thereof so that vibration of said second end imparts forward impulses to the cutter blade drive the blade intermittently forward.

24. The apparatus of claim 18 or 23 and comprising a pair of said angulate beams spaced laterally from one another and attached to opposite ends of the tool to strike the cutter blade at its opposite ends, said beams being mirror images of one another and operating in unison to impart forward impulses to the cutter blade at its opposite ends.

25. The apparatus of claim 18 or 23 wherein the tool comprises a loading bucket for an earth-moving device.

26. The apparatus of claim 25 wherein the earth-moving device is mining transporter.

27. The apparatus of claim 18 or 23 wherein the tool includes a compartment formed in the front surface of the tool and extending frontwardly with respect to the working surface of the tool, said compartment having a generally concave forward surface, and wherein the mounting flange is attached to the back of the forward surface of the compartment.

28. The apparatus of claim 27 wherein the tool has a pair of said compartments on opposite ends thereof, and wherein the beam comprises a matched pair of beams located in the respective compartments.

29. The apparatus of claim 18 or 23 wherein the cutter blade has a rearward extension extending to a position within striking distance of the cutter blade.

* * * * *